United States Patent [19]

Gomi et al.

[11] Patent Number: 4,844,312

[45] Date of Patent: Jul. 4, 1989

[54] APPARATUS FOR CONTROLLING TRAVERSE POSITION OF RUNNING STRIP

[75] Inventors: Takayuki Gomi; Fumio Kitamura, both of Chino, Japan

[73] Assignee: Kitamura Kiden Co., Ltd., Chino, Japan

[21] Appl. No.: 149,117

[22] Filed: Jan. 27, 1988

[30] Foreign Application Priority Data

Jan. 31, 1987 [JP] Japan ..... 62-19642

[51] Int. Cl.[4] ..... B65H 20/02

[52] U.S. Cl. ..... 226/21; 226/45

[58] Field of Search ..... 226/15, 3, 21, 45, 168; 242/57, 57.1

[56] References Cited

U.S. PATENT DOCUMENTS 3,570,735 3/1971 Kurz ..... 242/57.1 X

FOREIGN PATENT DOCUMENTS 0243756 4/1987 European Pat. Off. .
2565216 6/1985 France .
55-132027 10/1980 Japan .
60-28375 7/1985 Japan .
61-22851 6/1986 Japan .
2154494 11/1985 United Kingdom .

*Primary Examiner*—David Werner
*Attorney, Agent, or Firm*—Merchant, Gould, Smith, Edell, Welter & Schmidt

[57] ABSTRACT

In an apparatus for controlling a traverse direction of a running strip, a deviation of the running strip in the traverse direction with respect to a reference position is calculated, and the running strip is moved in the transverse direction in accordance with the deviation, thereby correcting the traverse position of the running strip.

12 Claims, 11 Drawing Sheets

APPARATUS FOR CONTROLLING TRAVERSE POSITION OF RUNNING STRIP

BACKGROUND OF THE INVENTION (1) Field of the Invention

The present invention relates to an apparatus for controlling a traverse position of a running strip. The apparatus according to the present invention can be, for example, applied to a winding controlling apparatus or a strip cutting apparatus for wound cores of transformers, or a winding apparatus or a cutting apparatus for soft plastic films.

(2) Description of the Related Art

As the iron cores of transformers, wound cores in which a strip having excellent magnetic characteristics is wound in a ring shape are now used. For example, a wound core is obtained by winding a strip on a winding spool to obtain a square, rectangular, stepped, or circular cross-section.

When winding a running strip on the winding spool, it is necessary to match the center position of the running strip in the traverse direction thereof with that of the winding spool in the traverse direction thereof. In this case, since the traverse position of the winding spool is conventionally stationary, it is necessary to adjust the traverse center position of the running strip. However, the thickness of the strip, which is already processed, is conventionally extremely thin; for example, an amorphous strip is about 0.025 mm thick, and a silicon steel strip is about 0.05 mm thick. Also, the center line of the processed strip is not always linear, since the width thereof is changed and Therefore, the strip is bent. Accordingly, when the running strip is wound on the winding spool, a large tension is generated on one side of the strip and a large stress is generated on the other side of the strip. As a result, the traverse center position of the strip is further deviated from the traverse center of the winding spool. Note that, generally, since a large tension is applied to the strip during a winding operation, the force causing the deviation of the strip is strong.

In the prior art, in order to maintain the traverse center of the strip at a predetermined position against the force causing the deviation of the strip, both sides of the strip are supported by position maintaining rollers, position guides, or guide grooves.

However, the above-mentioned deviation force is actually very large, and therefore, particularly in the case of a very thin strip, the part thereof in contact with the position maintaining rollers or the like is distorted or recessed, and as a result, it is impossible to maintain the traverse center position of the strip at a correct position and the strip may be damaged. Note that, if the traverse center position of the strip is not correct or if the strip is damaged, a wound core having a distorted cross-section is obtained, and as a result, it is impossible to obtain a predetermined magnetic characteristic.

Also, when at least one side of the strip is linear, it is possible to adjust the linear side edge of the strip to a definite position, however, even in this case, the above-mentioned problem occurs. In addition, when a material is cut into a plurality of strips by a continuous slitter apparatus having a pair of rotated round blades, and each of the strips are wound on a temporary winding spool or directly on a winding spool, the above-mentioned problem also occurs. Since the round blades have linear characteristics, when a curved strip is cut an alignment of the round blades with the material is required, but in this case, the deviation force becomes stronger. Further, it can become impossible to carry out a cutting operation, depending upon the degree of a curve or the material of the strip.

SUMMARY OF THE INVENTION

Therefore, an object of the present invention is to enable an easy adjustment of the traverse position of a running strip.

Another object of the present invention is to reduce the deviation of a running strip when the strip is being cut.

According to the present invention, in an apparatus for controlling a traverse direction of a running strip, a deviation of the running strip in the traverse direction with respect to a reference position is calculated, and the running strip is moved in the traverse direction in accordance with the deviation, thereby correcting the traverse position of the running strip.

Also, a laser cutting unit is provided in the controlling apparatus according to the present invention. The laser cutting unit has no directional characteristics, so that the deviation of the running strip is not increased.

BRIEF DESCRIPTION OF THE DRAWINGS

The present invention will be more clearly understood from the description as set forth below with reference to the accompanying drawings, wherein.

DESCRIPTION OF THE PREFERRED EMBODIMENTS

First, examples of wound cores will be explained with reference to FIGS. 1A, 1B, 1C, 2A, 2B, 3A, 3B, 4A, 4B, 5A, 5B, 6A, 6B, and 7.

Figures 1A, 1B, 1C:
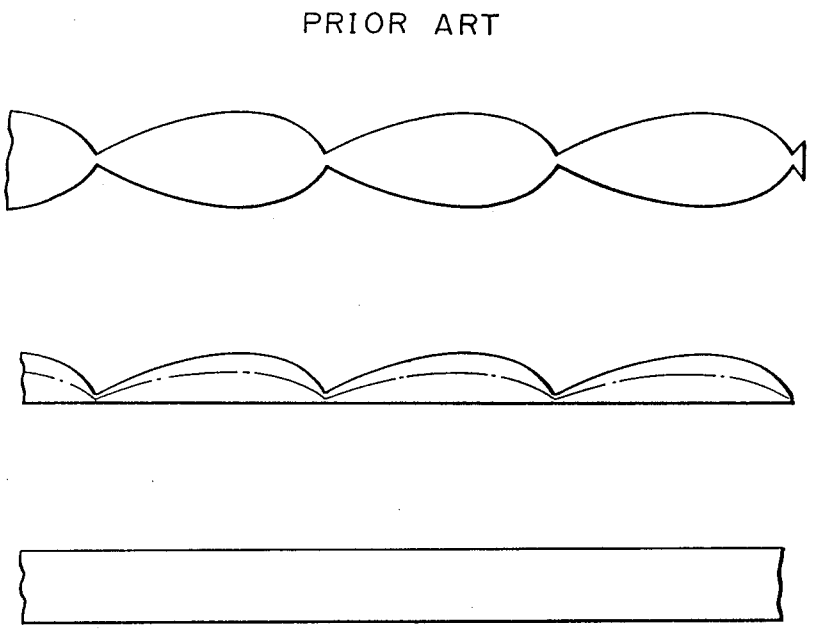
FIGS. 1A, 1B, and 1C are plan views showing examples of strips.
Figure 2A:
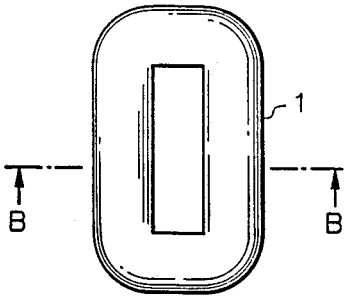
Fig. 2A PRIOR ART
FIGS. 2A, 3A, 4A, 5A, and 6A are plan views showing examples of wound cores.
Figure 3A:
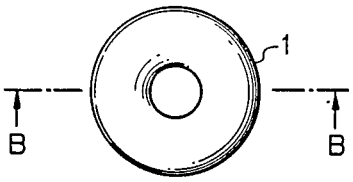
Figure 2B:
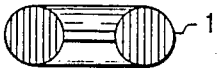
Fig. 2B PRIOR ART
FIGS. 2B, 3B, 4B, 5B, and 6B are cross-sectional views taken along the lines B—B of FIGS. 2A, 3A, 4A, 5A, and 6A, respectively.
Figure 3B:
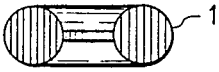
Figure 4A:
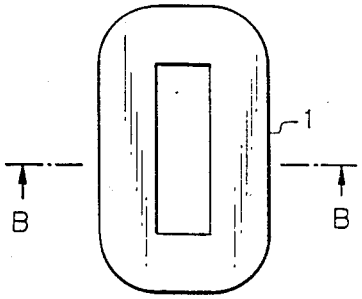
Fig. 4A PRIOR ART
Figure 5A:
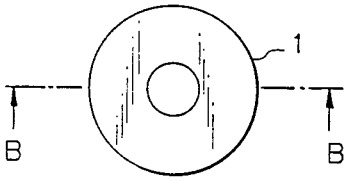
Figure 4B:
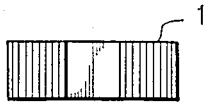
Fig. 4B PRIOR ART
Figure 5B:
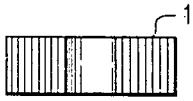
Figure 6A:
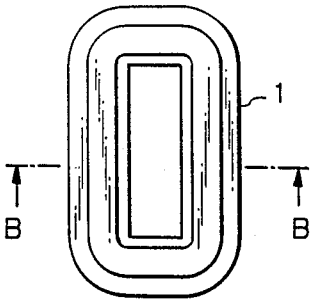
Figure 6B:
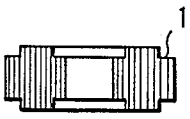
Figure 7:
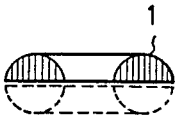
FIG. 7 is a cross-sectional view showing another example of a wound core.

A wound core 1 is obtained by winding a strip material having excellent magnetic characteristics, which material is cut in advance to a predetermined shape, as illustrated in FIGS. 1A, 1B, and 1C. That is, the cross-section of the wound core 1 is circular as illustrated in FIGS. 2A and 2B or in FIGS. 3A and 3B, square as illustrated in FIGS. 4A and 4B or in FIGS. 5A and 5B, stepped as illustrated in FIGS. 6A and 6B, or semicircular as in FIG. 7. When such a strip is wound on a winding spool, it is necessary to match the traverse center position of the strip with the center position of the winding spool. In this case, since the traverse position of the winding spool is conventionally stationary, it is necessary to adjust the traverse center position of the strip which is running. However, the thickness of the strip is generally very thin as explained above, and the center line of a strip is not always linear (see FIG. 1B). Further, the width of a strip is changed as illustrated in FIGS. 1A and 1B, and as a result, the strip is bent. Also, in the strip as illustrated in FIG. 1B, it is necessary to forcibly bend the center line. Therefore, when the strip is wound on the winding spool, a large tension is generated on one side of the strip and a large stress is generated on the other side of the strip. As a result, the traverse center of the strip is further deviated from the traverse center of the winding spool. Generally, since a large tension is applied to the strip during a winding operation, the force causing the deviation of the strip is strong.

Figure 8A:
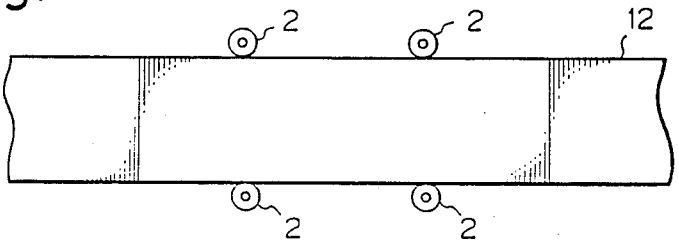
FIGS. 8A and 8B are plan views showing prior art mechanisms for adjusting the traverse position of a running strip.
Figure 8B:
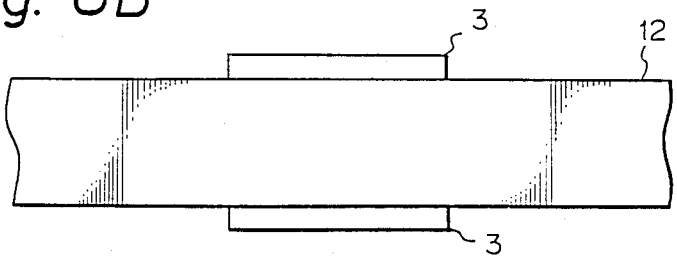
Figure 8C:
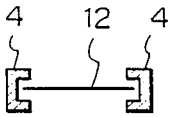
FIG. 8C is a cross-sectional view showing another prior art mechanism for adjusting the traverse position of a running strip.

In the prior art, in order to maintain the traverse center of the strip at a predetermined position against the deviation force on the strip, both sides of the strip are supported by position maintaining rollers 2 as illustrated in FIG. 8A, position guides 3 as illustrated in FIG. 8B, or guide grooves 4 as illustrated in FIG. 8C.

However, the above-mentioned deviation force is actually very large as explained above, and it is impossible to maintain the traverse center position of the strip at a correct position, and thus the strip may be damaged to thereby produce a distorted cross-sectional wound core. Thus, it is impossible for the wound core to obtain a predetermined magnetic characteristic.

Figure 9:
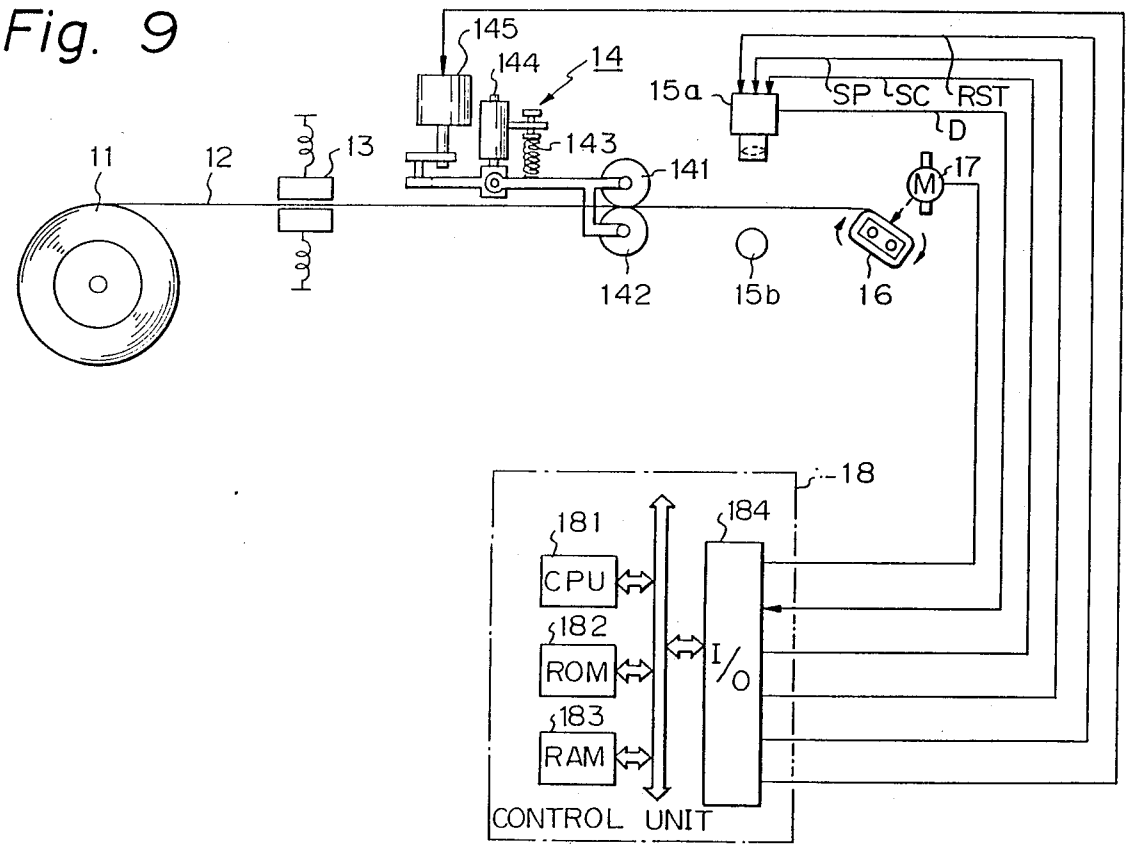
FIG. 9 is a schematic view illustrating a first embodiment of the apparatus for controlling a traverse position of a running strip according to the present invention.

In FIG. 9, which illustrates a first embodiment of the present invention, a winding apparatus for a wound core is illustrated. In FIG. 9, a strip 12 (in this case, a material is processed into the strip as illustrated in FIG. 1A, 1B, or 1C) is supplied from a strip coil 11, via a tension adjusting mechanism 13, a strip position moving portion 14, and an image sensor 15*a* and a light source 15*b* therefor, which serve as a strip position detecting portion, to a winding spool 16. Reference numeral 17 designates a driving motor for the winding spool 16.

Figure 10:
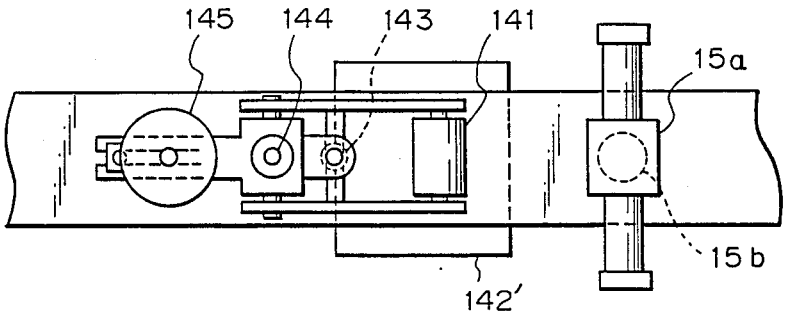
FIG. 10 is an enlarged plan view of the traverse position moving portion of FIG. 9.

As illustrated in FIG. 9, the strip position moving portion 14 is comprised of a pair of rollers 141 and 142, a spring 143 for pushing the roller 142 against the strip 12, a rotation shaft 144, a driving motor 145, and the like. In FIG. 10, which illustrates the strip position moving position 14 of FIG. 9 in detail, a stationary base 142' having a relatively small frictional force against the strip 12 is provided instead of the roller 142.

Figure 11A:
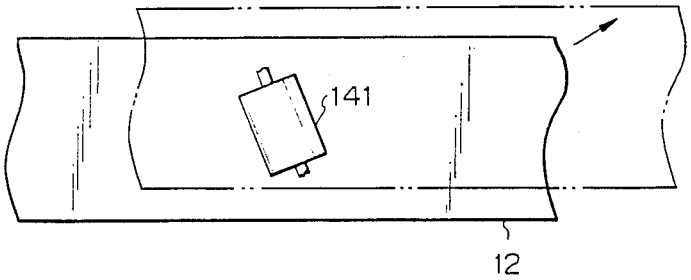
FIGS. 11A and 11B are views showing the operation of the traverse position moving portion of FIG. 9.
Figure 11B:
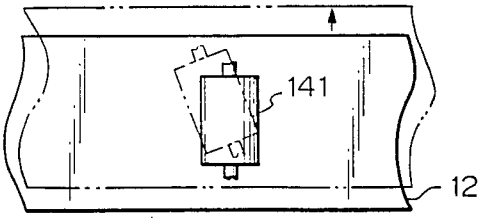

The rollers 141 and 142 are rotated by the rotation shaft 144 driven by the drive motor 144. Here, as material for the rollers 141 and 142, use is made of rubber or the like able to provide a relatively large frictional force against the strip 12 and to relax the torsion of the strip 12 due to the change of the direction thereof. Therefore, when the angle of the rollers 141 and 142 is gradually changed, the position of the running strip 12 is gradually changed as illustrated in FIG. 11A. Also, when the angle of the rollers 141 and 142 is rapidly changed, the position of the running strip 12 is rapidly changed as illustrated in FIG. 11B.

Figure 12:
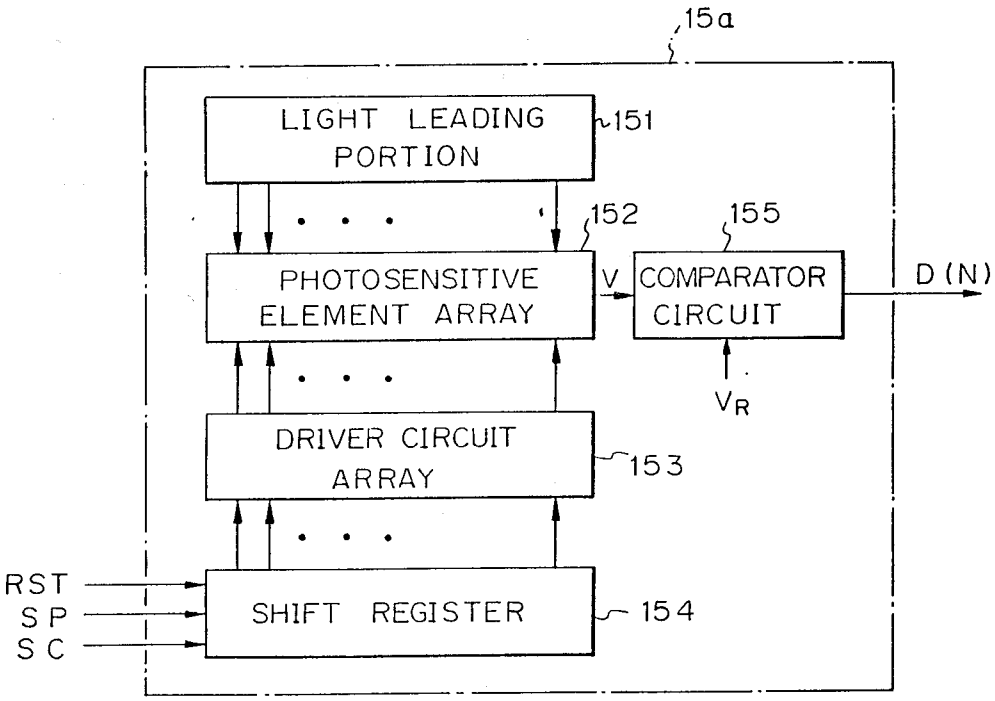
FIG. 12 is a block circuit diagram of the image sensor of FIG. 9.

As illustrated in detail in FIG. 12, the image sensor 15*a* is comprised of a light leading portion 151, a photosensitive element array 152 formed by photoelectric conversion elements, a drive circuit array 153 for driving the elements of the photosensitive element array 152, a shift register 154 for selecting drive circuits of the drive circuit array 153, and a comparator circuit 155 for comparing the output voltage V of the photosensitive element array 152 with a reference voltage $V_R$ to generate a digital output signal D(N). That is, in the photosensitive element array 152, the first photosensitive element, and the second photosensitive element, and . . . are sequentially driven, and the output voltage V is transmitted to the comparator circuit 155. For this purpose, a reset signal RST for resetting (clearing) the shift register 154, a start pulse SP for writing data "1" into the first stage of the shift register 154, and a shift clock SC for shifting this data "1" to the post stages are supplied from a control unit 18 to the shift register 154. Note that, the number of light leading holes of the light leading portion 151, the number of photosensitive elements of the photosensitive element array 152, the number of drive circuits of the drive circuit array 153, and the number of bits of the shift register 154 are all the same.

The control unit 18, which may be constructed by a microcomputer, includes a central processing unit (CPU) 181, a read-only memory (ROM) 182 for storing programs, tables (maps), constants, etc., a random access memory (RAM) 183 for storing temporary data, an input/output interface 184, and the like.

The operation of the control unit 18 of FIG. 9 will be explained with reference to the flowchart of FIG. 13.

Figure 13:
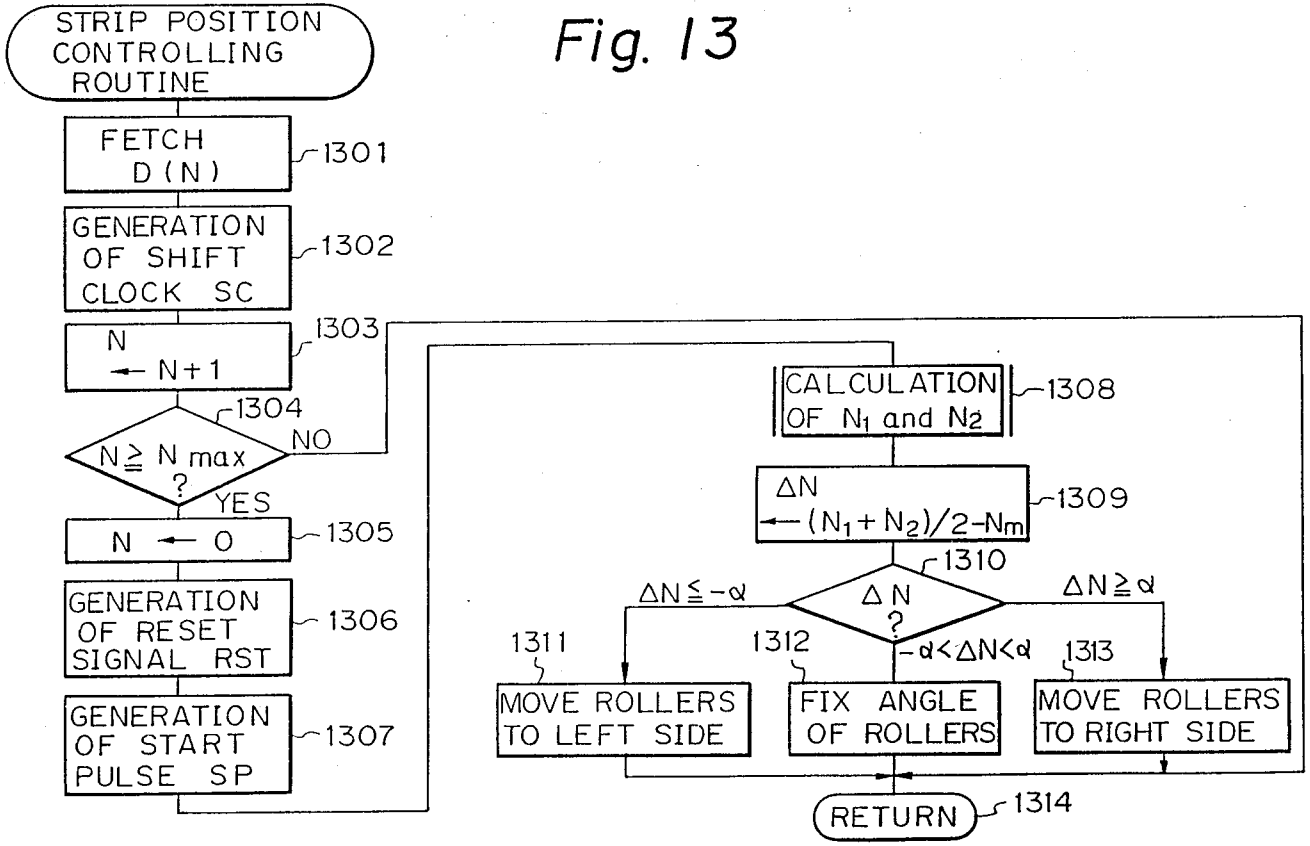
FIG. 13 is a flowchart showing the operation of the control unit of FIG. 9.

The routine of FIG. 13 is a timer interrupt routine for moving a traverse position of a running strip. At step 1301, the output voltage V of the N-th photosensitive element of the photosensitive element array 152, which element is activated, is fetched via the comparator circuit 155 and is stored in the RAM 183. Next, at step 1302, a shift clock SC is generated to shift data "1" by one bit within the shift register 154, and at step 1303, a counter value N is counted up by +1. At step 1304, it is determined whether or not the value of the counter value N has reached a predetermined value $N_{max}$. Note that the predetermined value $N_{max}$ is made smaller than the number of light leading holes of the light leading portion 151. As a result, only if $N \geqq N_{max}$, does the control proceed to steps 1305 to 1313. Otherwise, the control proceeds directly to step 1314.

At step 1305, the counter value N is cleared; at step 1306, a reset signal RST is generated to clear the shift register 154; and at step 1307, a start pulse SP is generated to write data "1" into the first bit of the shift register 154.

Figure 14:
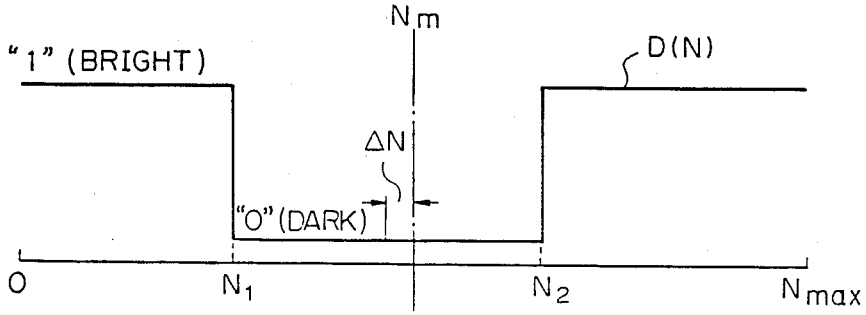
FIG. 14 is a diagram explaining the flowchart of FIG. 13.

At step 1308, end positions $N_1$ and $N_2$ of the strip 12 are calculated from the data D(N) ($N=0$ to $N_{max}-1$) stored in the RAM 183. That is, as illustrated in FIG. 14, the end position $N_1$ is calculated by sequentially scanning the data D(N) and detecting a first dark bit "0", and then the border point $N_2$ is calculated by further sequentially scanning the data D(N) and detecting a first bright bit "1". Next, at step 1309, a deviation amount ΔN of the traverse center position of the strip 12 with respect to the traverse center position of the winding spool 16 is calculated by $$\Delta N \leftarrow (N_1+N_2)/2-N_m$$

where $(N_1+N_2)2$ is a traverse center position of the strip 12, and $N_m$ is a traverse center position of the winding spool 16. Then, the control proceeds to step 1310.

At step 1310, it is determined whether the strip 12 is shifted to the right or to the left with respect to the traverse center position $N_m$ of the winding spool 16. As a result, if the shift is to the right ($\Delta N \leqq -\alpha$), the control proceeds to step 1311 which drives the motor 145 to move the rollers 141 and 142 to the left. Conversely, if the shift is to the left ($\Delta N \geqq \alpha$), the control proceeds to step 1313 which drives the motor 145 to move the rollers 141 and 142 to the right. If the amount of deviation is small ($-\alpha < \Delta N < \alpha$), the control proceeds to step 1312 which stops the motor 145 and thus fixes the rollers 141 and 142 at their previous positions. Note that the value $\alpha$ is an appropriate value. Also, note that the driving speed of the motor 145 can be changed in accordance with the deviation amount ΔN.

Then, this routine is completed by step 1314.

Note that, if the determination at step 1304 is negative, the driving state of the motor 145 is held at a previous state, and accordingly, the traverse center position of the strip 12 is maintained at a predetermined position which is, in this case, the traverse center position of the winding spool 16.

Figure 16:
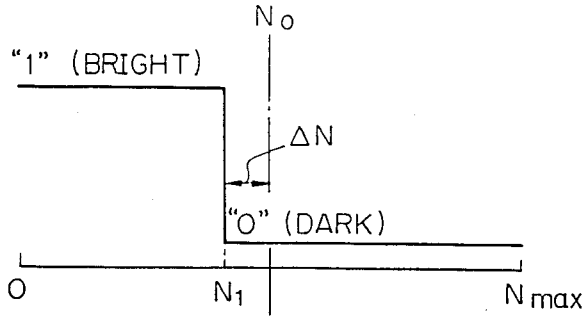
FIG. 16 is a diagram explaining the flowchart of FIG. 15.
Figure 15:
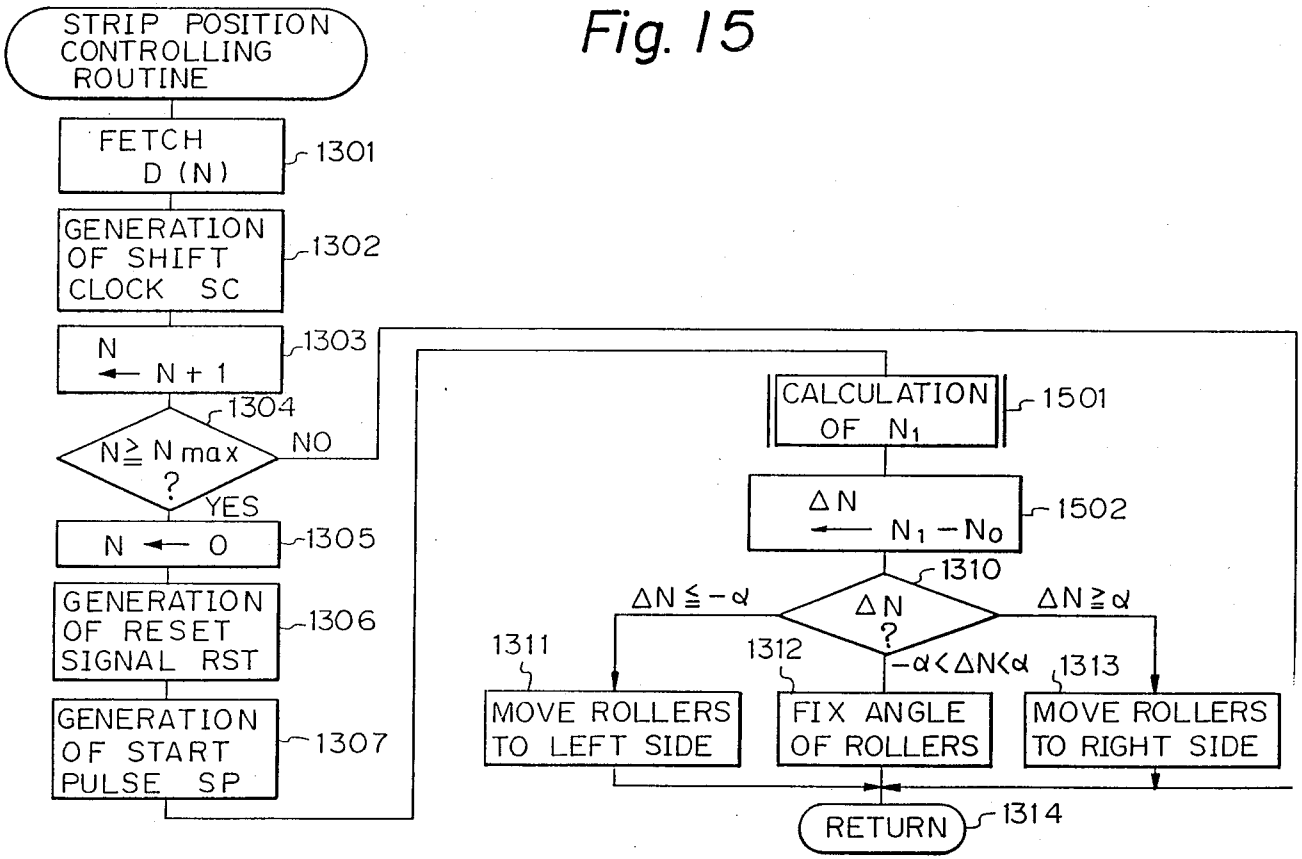
FIG. 15 is a modification of FIG. 13.

In FIG. 15, which is a modification of FIG. 13, steps 1501 and 1502 are provided instead of steps 1308 and 1309. In this case, instead of calculating the traverse center position of the strip 12, the position of one end of the strip 12 is calculated, and as a result, the angle of the rollers 141 and 142 is adjusted so that this end position is at a predetermined position. That is, at step 1501, an end position $N_1$ of the strip 12 is calculated from the data D(N) ($N=0$ to $N_{max}-1$) stored in RAM 183. Namely, as illustrated in FIG. 16, the end position $N_1$ is calculated by sequentially scanning the data D(N) and detecting a first dark bit "0". Next, at step 609', a deviation amount ΔN of the end position of th strip 12 is calculated by $$\Delta N \leftarrow N_1-N_0$$

where $N_0$ is a value corresponding to a predetermined position of the winding spool 16.

Note that, the routine of FIG. 15 is applied to strips having at least one linear side as illustrated in FIGS. 1B and 1C.

Figure 17:
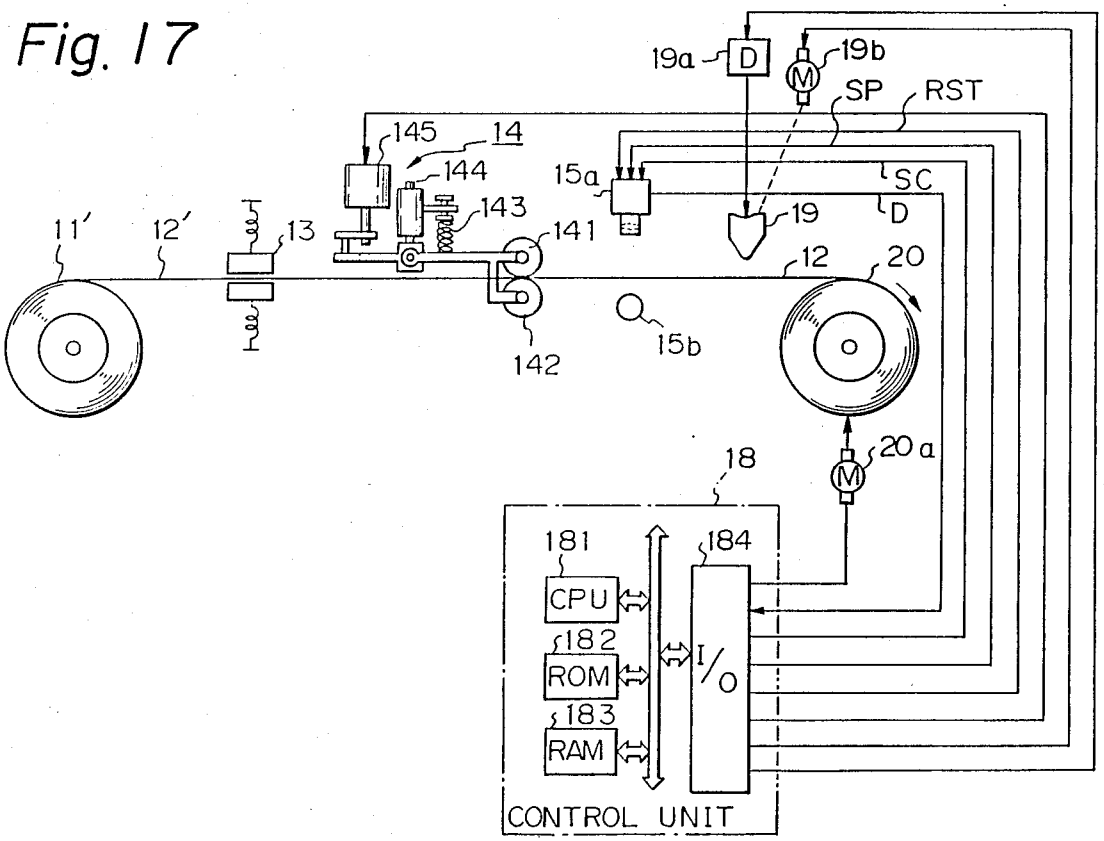
FIGS. 17 and 18 are schematic views illustrating second and third embodiments of the apparatus for controlling a traverse position of a running strip according to the present invention.

In FIG. 17, which illustrates a second embodiment of the present invention, a strip cutting apparatus for a wound core, i.e., a continuous slitter apparatus for a wound core is illustrated. In FIG. 17, a material 12' is supplied from a material coil 11' via the tension adjusting mechanism 13, the strip (material) position moving portion 14, and the strip (material) position detecting portions **15*a* and 15*b*, to a laser cutting unit 19 as a cutting portion. Then, the cut strip 12 is wound on a temporary winding spool 20. Reference 19*a* designates a drive unit for driving the laser cutting unit 19, 19*b* a motor for moving the laser cutting unit 19, and 20 a motor for driving the temporary winding spool 20. These elements all connected to the input/output interface 184 of the control unit 18**.

The control of the drive circuit **19*a* and the motor 19*b* of the laser cutting unit 19 is carried out in accordance with a predetermined curve having a function of the length of the strip 12 wound on the temporary winding spool 20**, or a predetermined straight line.

When the laser cutting unit 19 is used, the laser cutting unit 19 has no directional characteristics, thereby cutting a free curve. As a result, the force deviating the strip 12 from the center position thereof is reduced, and this contributes to an improvement of the accuracy of the adjustment of the position of the strip 12 or the material 12'.

Figure 18:
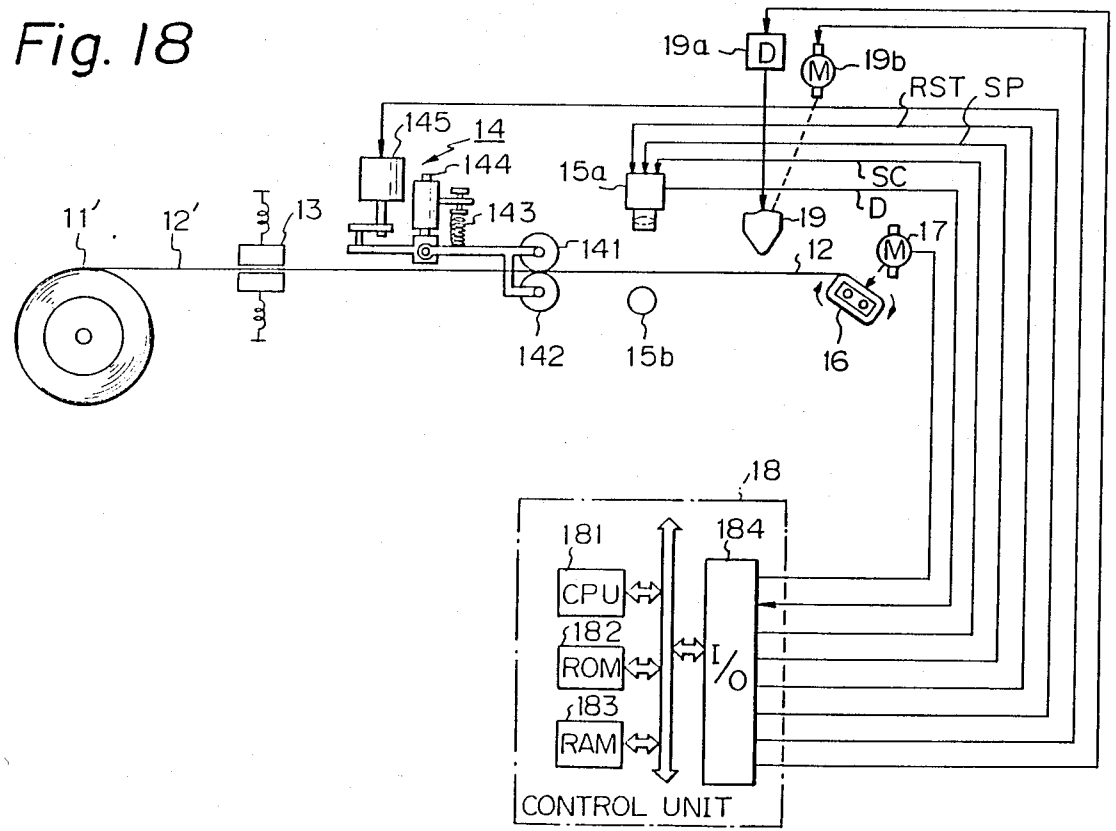

In FIG. 18, which illustrates a third embodiment of the present invention, of strip cutting apparatus for a wound core, i.e., a continuous slitter apparatus is illustrated. Different from FIG. 17, a winding spool 16 is provided instead of the temporary winding spool 20. Therefore, in this case, the cut strip 12 is wound on the winding spool 16, thereby directly obtaining a wound core.

In FIG. 18, the position adjustment and cutting of a strip (or a material) are also carried out in the same way as in FIG. 17.

Note that, although only one strip position moving portion 14 is provided in the above-mentioned embodiments, two or more strip position moving portions can be provided. Such a portion may be arranged immediately before the winding operation following the cutting operation. Also, although only one laser cutting unit 19 is provided, two or more laser cutting units can be utilized. Further, an appropriate means can be provided instead of the image sensor **15*a***.

As explained above, according to the present invention, the traverse position of a running strip including a running material can be easily adjusted. Also, since the force causing the deviation of the strip can be reduced by the laser cutting unit, the accuracy of the traverse position of the strip is improved.

We claim:

1. An apparatus for controlling a traverse position of a running strip, comprising:

means for detecting a traverse position of said running strip;

means for calculating a traverse distance between said traverse position of said running strip and a reference position;

means for moving said running strip in the traverse direction thereof in accordance with said traverse distance so that said traverse position of said running strip is located at said reference position;

said strip moving means comprising a pair of rollers for sandwiching said running strip, a rotation shaft perpendicular to the surface of said running strip for rotatably supporting said rollers; and means for adjusting an angle of said pair of rollers relative to said running strip in accordance with said traverse distance, thereby moving said running strip in the traverse direction thereof using a frictional force generated between said pair of rollers and said running strip.

2. An apparatus as set forth in claim 1, wherein said traverse position detecting means comprises an image sensor means.

3. An apparatus as set forth in claim 1, wherein said strip moving means moves said running strip in the traverse direction thereof at a speed dependent upon said traverse distance.

4. An apparatus as set forth in claim 1, wherein said traverse position of said running strip is a center position in the traverse direction thereof.

5. An apparatus as set forth in claim 1, wherein said traverse position of said running strip is an edge position in the traverse direction thereof.

6. An apparatus as set forth in claim 1, further comprising means for cutting said running strip by using a laser.

7. An apparatus for controlling a traverse position of a running strip, comprising:

means for detecting a traverse position of said running strip;

means for calculating a traverse distance between said traverse position of said running strip and a reference position;

means for moving said running strip in the traverse direction thereof in accordance with said traverse distance so that said traverse position of said running strip is located at said reference position;

said strip moving means comprising a roller provided on one side of said running strip, said roller having a relatively large frictional force against said running strip;

a rotation shaft perpendicular to the surface of said running strip for rotatably supporting said roller;

a stationary base provided on the other side of said running strip, said stationary base having a relatively small frictional force against said running strip; and means for adjusting the relative angle of said roller to said running strip in accordance with said traverse distance, thereby moving said running strip in the traverse direction thereof using a frictional force generated between said roller and said running strip.

8. An apparatus as set forth in claim 7, wherein said traverse position detecting means comprises an image sensor means.

9. An apparatus as set forth in claim 7, wherein said strip moving means moves said running strip in the traverse direction thereof at a speed dependent upon said traverse distance.

10. An apparatus as set forth in claim 7, wherein said traverse position of said running strip is a center position in the traverse direction thereof.

11. An apparatus as set forth in claim 7, wherein said traverse position of said running strip is an edge position in the traverse direction thereof.

12. An apparatus as set forth in claim 7, further comprising means for cutting said running strip by using a laser.

* * * * *